US007287668B1

(12) United States Patent
Renaud

(10) Patent No.: US 7,287,668 B1
(45) Date of Patent: Oct. 30, 2007

(54) SOAP HOLDING AND DISPERSING ASSEMBLY

(76) Inventor: Richard Renaud, 8-12 Wandell Rd., Central Apts Apt 84, Miranda (AU) 2228

( * ) Notice: Subject to any disclaimer, the term of this patent is extended or adjusted under 35 U.S.C. 154(b) by 267 days.

(21) Appl. No.: 11/124,543

(22) Filed: May 9, 2005

(51) Int. Cl.
*B65G 59/00* (2006.01)

(52) U.S. Cl. ..... 221/283; 221/155; 221/309

(58) Field of Classification Search ..... 232/22, 232/42; 221/283, 155; 220/482; 222/180; 248/215, 229.12, 279.1, 301
See application file for complete search history.

(56) References Cited

U.S. PATENT DOCUMENTS 1,890,295 A * 12/1932 Jacobs ..... 221/45
2,902,187 A * 9/1959 Cabanban ..... 221/240
3,164,298 A * 1/1965 Repko ..... 221/282
3,251,158 A 5/1966 Dean et al.
4,382,526 A 5/1983 Stone
4,739,922 A 4/1988 Zimmermann
4,872,224 A * 10/1989 Grimes et al. ..... 4/541.3
4,928,849 A * 5/1990 Khozai ..... 221/45
4,938,345 A 7/1990 Bolton
5,425,474 A 6/1995 Dalea et al.
5,624,071 A * 4/1997 Sosan ..... 232/17
D475,873 S 6/2003 Mello
6,722,526 B1 * 4/2004 Passetti ..... 221/155

* cited by examiner

*Primary Examiner*—Gene O. Crawford
*Assistant Examiner*—Timothy Waggoner

(57) ABSTRACT

A soap holding and dispersing assembly includes a housing that has a bottom wall, a top wall and a peripheral wall that extends between and is attached to the top and bottom walls. The peripheral wall includes a front wall, a back wall, a first side wall and a second side wall. The front wall has an opening therein positioned adjacent to the bottom wall that extends between the first and second side walls. A coupler is attached to the housing. The coupler attaches the housing to a horizontally orientated upper edge of a door. A plurality of bars of soap is positioned in the housing and each is extendable outwardly through the opening in the front wall.

4 Claims, 2 Drawing Sheets

SOAP HOLDING AND DISPERSING ASSEMBLY

BACKGROUND OF THE INVENTION

1. Field of the Invention

The present invention relates to soap holding devices and more particularly pertains to a new soap holding device for holding and dispending a plurality of bars of soap.

2. Description of the Prior Art

The use of soap holding devices is known in the prior art. U.S. Pat. No. 4,938,345 describes a dispensing and draining device for cleaning articles. A holding device is found U.S. Pat. No. 4,739,922 and is adapted for holding a plurality of articles in a stacked orientation so that the articles may be selectively dispensed. A design for a soap bar dispenser is found in U.S. Pat. Des. No. 475,873.

While these devices fulfill their respective, particular objectives and requirements, the need remains for a device that holds a plurality of bars of soap in a stacked orientation and is adapted for dispensing the bars of soap one at a time. The device should also be adapted for being mounted on a vertical surface, such as a door, so that the bars of soap are easily accessible and to prevent damage to the device. Additionally, by mounting the device on the door, the soap will be protected from getting wet and dissolving.

SUMMARY OF THE INVENTION

The present invention meets the needs presented above by generally comprising a housing has a bottom wall, a top wall and a peripheral wall that extends between and is attached to the top and bottom walls. The peripheral wall includes a front wall, a back wall, a first side wall and a second side wall. The front wall has an opening therein positioned adjacent to the bottom wall that extends between the first and second side walls. A coupler is attached to the housing. The coupler attaches the housing to a horizontally orientated upper edge of a door. A plurality of bars of soap is positioned in the housing and each is extendable outwardly through the opening in the front wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
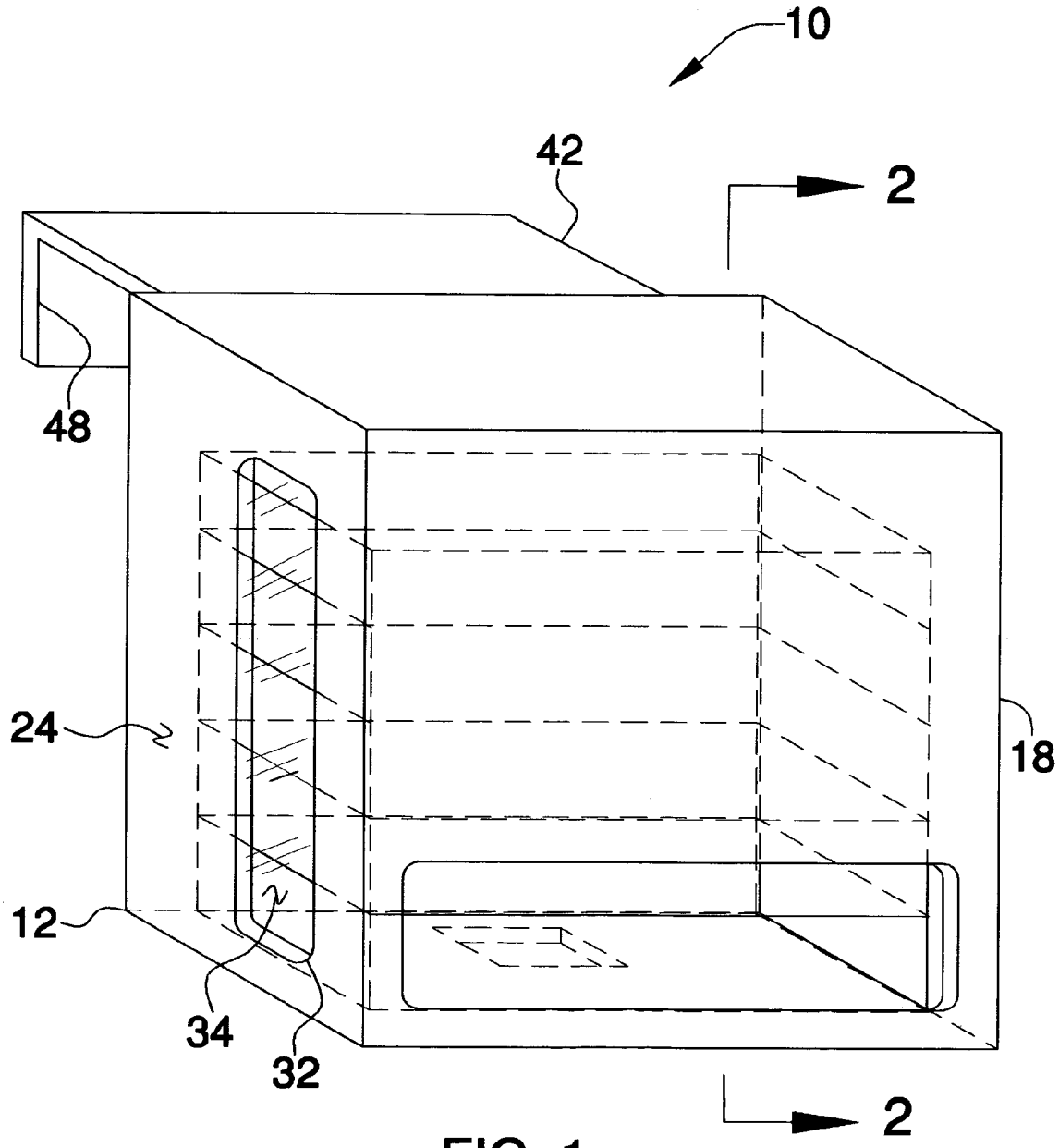
FIG. 1 is a perspective view of a soap holding and dispersing assembly according to the present invention.

With reference now to the drawings, and in particular to FIGS. 1 through 4 thereof, a new soap holding device embodying the principles and concepts of the present invention and generally designated by the reference numeral 10 will be described.

As best illustrated in FIGS. 1 through 4, the soap holding and dispersing assembly 10 generally comprises a housing 12 that has a bottom wall 14, a top wall 16 and a peripheral wall 18 extending between and being attached to the top 16 and bottom 14 walls. The peripheral wall 18 includes a front wall 20, a back wall 22, a first side wall 24 and a second side wall 26. The front wall 20 has an opening 28 therein positioned adjacent to the bottom wall 14 and generally extends between the first 24 and second 26 side walls. The bottom wall 14 has an aperture 30 therein positioned generally adjacent to the back wall 22. The first side wall 24 has a window 32 positioned therein. A transparent covering 34 is positioned over the window 32. The second side wall 26 may also have a window 36 positioned therein, again with a transparent covering 38.

A coupler 40 is attached to the housing 12. The coupler 40 attaches the housing 12 to a horizontally orientated upper edge of a door 8. The coupler 40 includes a panel 42 that has a rear edge 44 and a forward edge 46. A first leg 48 is attached to and extends downwardly from the rear edge 44. A second leg 50 is attached to and extends downwardly from the forward edge 46. Each of the first 48 and second 50 legs is orientated perpendicular to the panel 42. The panel 42 is positioned in a slot 52 in the back wall 22 so that the second leg 50 is positioned within the housing 12 and extends toward the bottom wall 14. The slot 52 is positioned adjacent to the top wall 16. The first leg 48 is selectively abutted against the back wall 22 in a stored position or spaced from the back wall 22 in a mounting position.

Figure 3:
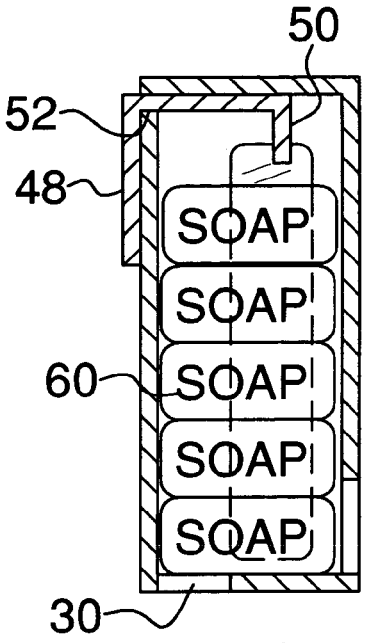
FIG. 3 is a cross-sectional view of the present invention.
Figure 2:
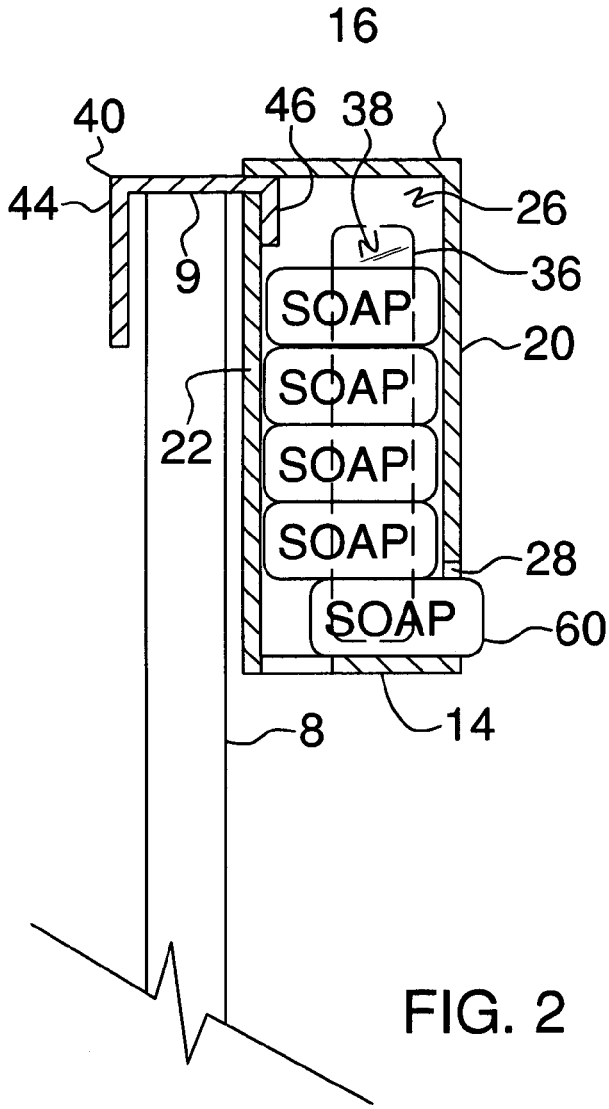
FIG. 2 is a cross-sectional view taken along line 2-2 of FIG. 1 of the present invention.
Figure 4:
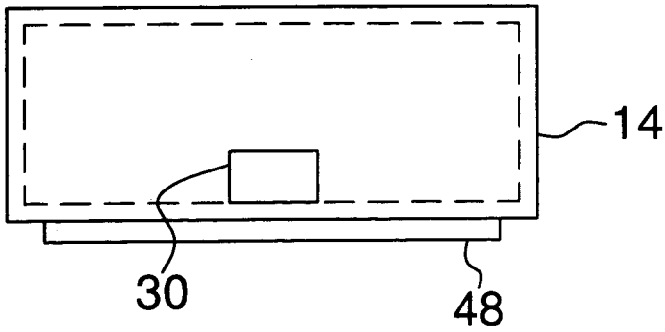
FIG. 4 is a bottom view of the present invention.

A plurality of bars of soap 60 is positioned in the housing 12 and is selectively extendable outwardly through the opening 28 in the front wall 20. The housing 12 has an interior length and width substantially equal to a length and width of the bar of soap 60. The bars of soap 60 are stacked on each other as shown in FIG. 3. The aperture 30 aids a person in sliding the bars 60 out through the opening 28.

In use, the housing 12 may be attached to an upper edge 9 of a door 8 or wall for supporting the housing off 12 of a floor surface. This allows the housing 12 to be constructed out of cardboard without risk of the housing 12 being damaged. When used as packaging for bars of soap 60, the opening 28 and aperture 30 may be covered with removable coverings. The window 32 in the first side wall 24 allows a person to see how many bars of soap 60 remain in the housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bar soap packaging and dispensing assembly for holding a plurality of bars of soap, said assembly comprising:

a housing having a bottom wall, a top wall and a peripheral wall extending between and being attached to said top and bottom walls, said peripheral wall including a front wall, a back wall, a first side wall and a second side wall, said front wall having an opening therein positioned adjacent to said bottom wall and generally extending between said first and second side walls;

a coupler being attached to said housing, said coupler attaching said housing to a horizontally orientated upper edge of a door, said coupler including a panel having a rear edge and a forward edge, a first leg being attached to and extending downwardly from said rear edge, a second leg being attached to and extending downwardly from said forward edge, each of said first and second legs being orientated perpendicular to said panel, said panel being positioned in a slot in said back wall such that said second leg is positioned within said housing and extends toward said bottom wall, said slot being positioned adjacent to said top wall, said first leg being selectively abutted against said back wall in a stored position or spaced from said back wall in a mounting position; and a plurality of bars of soap being positioned in said housing and being selectively extendable outwardly through said opening in said front wall.

2. The assembly according to claim 1, wherein said bottom wall has an aperture therein.

3. The assembly according to claim 1, wherein said first side wall having a window positioned therein, a transparent covering being positioned over said window.

4. A bar soap packaging and dispensing assembly for holding a plurality of bars of soap, said assembly comprising:

a housing having a bottom wall, a top wall and a peripheral wall extending between and being attached to said top and bottom walls, said peripheral wall including a front wall, a back wall, a first side wall and a second side wall, said front wall having an opening therein positioned adjacent to said bottom wall and generally extending between said first and second side walls, said bottom wall having an aperture therein, said aperture being positioned generally adjacent to said back wall, said first side wall having a window positioned therein, a transparent covering being positioned over said window;

a coupler being attached to said housing, said coupler attaching said housing to a horizontally orientated upper edge of a door, said coupler including a panel having a rear edge and a forward edge, a first leg being attached to and extending downwardly from said rear edge, a second leg being attached to and extending downwardly from said forward edge, each of said first and second legs being orientated perpendicular to said panel, said panel being positioned in a slot in said back wall such that said second leg is positioned within said housing and extends toward said bottom wall, said slot being positioned adjacent to said top wall, said first leg being selectively abutted against said back wall in a stored position or spaced from said back wall in a mounting position; and a plurality of bars of soap being positioned in said housing and being selectively extendable outwardly through said opening in said front wall.

* * * * *